United States Patent [19]

Boyle et al.

[11] 4,301,679

[45] Nov. 24, 1981

[54] WELL FLOW SAMPLING SYSTEM

[75] Inventors: George J. Boyle, Neston; Norman Coleclough, Bromborough, both of England

[73] Assignee: Shell Oil Company, Houston, Tex.

[21] Appl. No.: 105,810

[22] Filed: Dec. 20, 1979

[30] Foreign Application Priority Data

Feb. 2, 1979 [GB] United Kingdom ..... 3826/79

[51] Int. Cl.[3] ..... E21B 47/00

[52] U.S. Cl. ..... 73/155

[58] Field of Search ..... 73/422 R, 422 TC, 155, 73/153; 166/264; 137/3, 599; 366/340

[56] References Cited

U.S. PATENT DOCUMENTS 2,662,401 12/1953 Bailly ..... 73/153

3,377,867 4/1968 Nitescu ..... 73/422 R

FOREIGN PATENT DOCUMENTS 1546006 5/1979 United Kingdom .

*Primary Examiner*—Jerry W. Myracle

[57] ABSTRACT

Method of taking a sample from a flow of fluid passing out of a well communicating with a permeable subsurface formation, which fluid comprises gaseous and liquid components, the method including the steps of allowing the fluid to flow from the well at a predetermined pressure, mixing the components of the fluid flowing at this pressure, draining a sample stream of the mixed components at this pressure, and storing the components at a pressure that is approximately equal to this pressure.

18 Claims, 3 Drawing Figures

WELL FLOW SAMPLING SYSTEM

BACKGROUND OF THE INVENTION

The invention relates to a method and means for taking a sample from a flow of fluid comprising gaseous and liquid components, such as hydrocarbon fluid passing out of a well communicating with a permeable underground formation.

Prior to developing a hydrocarbon-containing formation for a full-scale recovery of liquid and gaseous hydrocarbons therefrom, the properties of the hydrocarbons to be recovered must be determined. The knowledge of these properties is required for designing a scheme for treating the hydrocarbon fluid in the well site, and for designing the pipeline through which the fluid is to be transported from the site to a loading station or refinery.

In prior art techniques for appraisal testing of a new well, full-scale gas/liquid separator equipment is installed temporarily on the site and the well is allowed to produce at the desired production rate. The hydrocarbons are then passed through the separator equipment at a relatively low pressure, such as 1,000 psi (70 kg/cm$^2$). After an equilibrium has been reached in the production, the quantities of gas and liquid passing through the separator per unit of time are measured, and a sample is taken from the volumes of liquid and gas. The samples are bottled and transported to a laboratory for further testing in order to obtain information on the composition and phase behavior thereof.

SUMMARY OF THE INVENTION

An object of the present invention is a method for taking a sample from a flow of fluid passing out of a well during an appraisal testing procedure, which method allows the required sampling to take place in a simple and reliable manner.

Another object of the present invention is a means for taking a sample from a flow of fluid passing out of a well in appraisal or production testing of the well, which means can relatively easily be transported to a well site, such as a site that cannot be reached along a road.

According to the invention, the method for taking a sample from a flow of fluid passing out of a well communicating with a permeable underground formation, which fluid comprises gaseous and liquid components, comprises the steps of allowing the fluid to flow from the well at a predetermined pressure, mixing the components of the fluid flowing at this pressure, draining a sample stream of the mixed components at this pressure, and storing the components at a pressure that is approximately equal to this pressure.

The components of the sample stream may be separated in a gas/liquid separator operating at approximately the predetermined pressure, and subsequently stored in separate containers.

According to the invention, the means for taking a sample from a flow of fluid passing out of a well communicating with a permeable underground formation comprises a conduit system system with an inlet and an outlet, the inlet being suitable for being brought into communication with the interior of the well. The conduit system includes a first pipe and a second pipe through which pipes parallel flow of fluid may take place from the inlet to the outlet. Each pipe cooperates with valve means arranged to close off the passage through the pipe at will. A mixing means is arranged in the interior of the second pipe, and a fluid sampling conduit communicates at the entry thereto with the interior of the second pipe in the proximity of the fluid mixing means.

The means according to the invention may be brought into communication with the well via the inlet thereof, and fluid passing out of the well is then first passed solely through the first pipe and subsequently solely through the second pipe. The sample stream of mixed components is drained via the fluid sampling conduit during at least part of the period in which the fluid passes solely through the second pipe.

BRIEF DESCRIPTION OF THE DRAWINGS

The invention will hereinafter be described by way of example in more detail with reference to the drawings, which show one embodiment of the invention.

DESCRIPTION OF A PREFERRED EMBODIMENT

Figure 1:
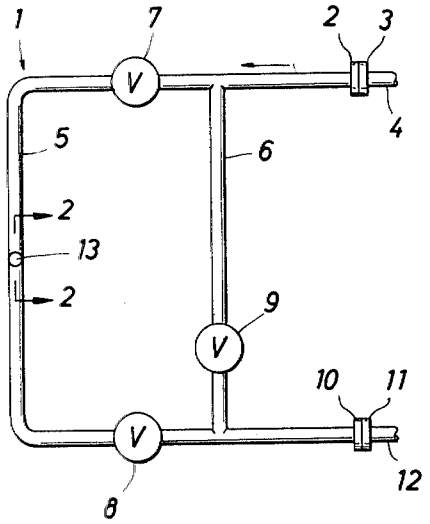
FIG. 1 shows schematically the means according to the invention.

The means according to the invention comprises a conduit system 1 having an inlet flange 2 suitable for being coupled to a flange 3 of a pipe 4 that communicates with a well (not shown). The conduit system 1 comprises two pipes 5 and 6, allowing parallel flow of fluids. The passage through the pipe 5 may be controlled by the valves 7 and 8, whereas the passage through the pipe 6 may be controlled by the valve 9. The conduit system 1 further comprises an outlet flange 10 adapted for being coupled to a flange 11 of a pipe 12. The pipe 12 may lead to a storage container, or to any other place where the fluids produced from the well may be stored or used.

The pipe 5 is provided with a sample point 13 at which samples can be taken of the fluid passing through this pipe. A more detailed longitudinal section of the sample point 13 will now be described with reference to FIGS. 2 and 3.

The sample point 13 includes a mixing means consisting of an annular support 14 and a body 15 (see FIG. 2) that are arranged within the pipe 5. The body 15 has a circular cross-section and is provided with a plurality of passages 16 extending between the upstream side of the body and the downstream side thereof. Upstream side and downstream side of the body 15 correspond in the embodiment shown in FIG. 2 with the upper side and the lower side, respectively, of said body.

The passages 16 are arranged such that the central axes of said passages all pass through a common point of the central axis of the vertical section of the pipe 5, which point is located downstream of the body 15.

Figure 3:
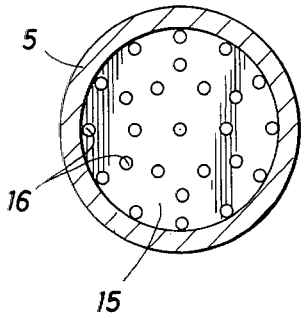
FIG. 3 shows a cross-section along the line 3—3 of FIG. 2.

FIG. 3 shows a top view of the body 15. In the embodiment shown, the passages 16 have a circular cross-section. The entrance openings to the passages 16 are evenly distributed over the area of the upstream side of the body 15. The centers of the circular entrance openings of the passages are located on concentric circles, and the peripheries of the outer row of openings touch the periphery of the upstream side of the body 15.

A groove with O-ring 17 is arranged in the lower side of the body 15, which O-ring seals on the upper side of the annular support 14. The O-ring is compressed by the fluid flowing downwards in the direction of the arrow 18. The annular support 14 is kept in place within the pipe 5 by means of the weld 19.

At the same point 13, an opening 20 exists in the wall of the pipe 5, which opening corresponds with the hole 21 in the annular support 14. A sample conduit 22 passes through the opening 20 and the hole 21, such that the center of the open end 23 of the sample conduit 22 is located on the central axis of the annular support 14, which central axis coincides with the central axis of the body 15. In this position of the sample conduit, the ring 24 attached thereto is in contact with the part 25 of the pipe 5. A sealing plug 26 surrounds the conduit 22 at the entrance of the opening 20, which entrance has a diameter larger than the diameter of the rest of the opening 20.

The operation of the means according to the invention will now be described with reference to FIG. 1 and FIGS. 2 and 3 of the drawing.

The conduit system 1 is transported to the site where a testing procedure (such as an appraisal test of an oil and gas producing well) will be carried out. In case of transport problems, the system may be formed of separate parts that are interconnected by coupling means, such as flanges. These coupling means are well known in the art and do not need any further description. The conduit system is then transported in separate parts and assembled on site such that it is in the position as shown in FIG. 1 with pipe 5 vertically oriented and has the inlet flange 2 thereof connected to a pipe 4 with flange 3, which pipe 4 communicates with the well through a suitable valve means (not shown).

The outlet flange 10 of the conduit system 1 is connected to a pipe 12 which leads to a disposal means, such as a burner or storage container (not shown). If desired, a gas/oil separator and/or a volume meter may be installed between the flange 11 and the pipe 12.

In carrying out the sampling procedure, the valve 9 in the pipe 6 is fully opened, whereas the valves 7 and 8 in the pipe 5 are closed. By opening the valve (not shown) in the pipe 4 that communicates with the well to be tested, fluid from this well is allowed to pass through the pipe 6 to the pipe 12 leading to disposal. The fluid is produced from the well at a predetermined pressure and at a predetermined flow. The flow rate may be controlled by means of a choke manifold (not shown) containing a variable choke and/or an adjustable choke. Such choke means may be arranged between the flanges 10 and 11 These means are well known, and do not require a detailed description. The choke means are selected such that the well produces at a predetermined rate and at a predetermined pressure. This pressure is also indicated as wellhead pressure.

After an equilibrium in production of fluid from the well has been reached, the wellhead fluid stream is directed through the pipes by opening the valves 7 and 8, and closing the valve 9 of the pipe 6 that by-passes the pipe 5 of the conduit system 1.

The fluid produced from the well comprises gaseous as well as liquid components. By passing through the body 15 in the pipe 5, the components of the fluid are intensively mixed since the passages 16 in the body 15 converge to a common point that is situated on the central axis of the body 15. As a result thereof, a homogeneous mixture of the fluid components flows through the central passage of the annular support 14 of the body 15, and the sample that is being taken through the sample conduit 22 is representative of the fluid that is being produced from the well.

Figure 2:
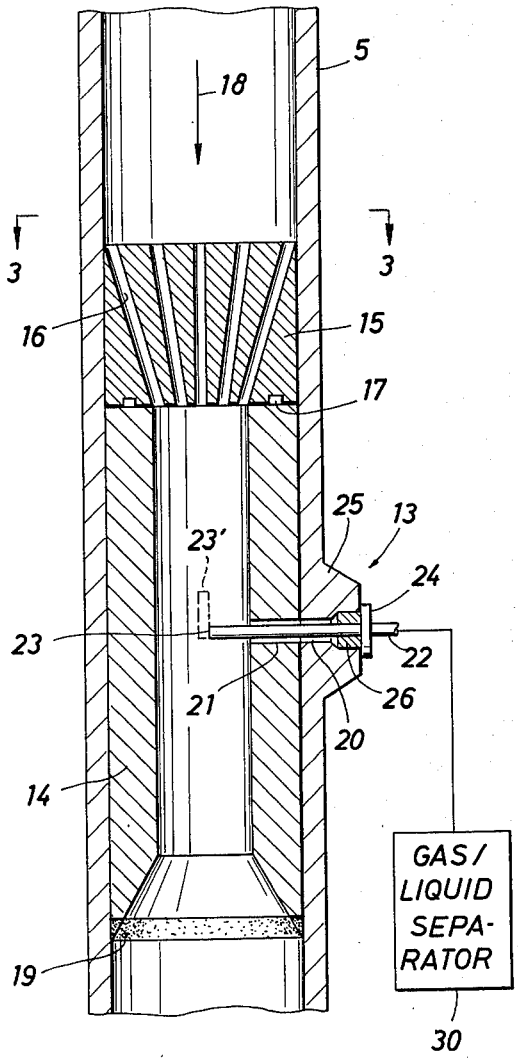
FIG. 2 shows (on a larger scale) section 2—2 of FIG. 1.

The mixing means shown in FIGS. 2 and 3 may be interchanged with a mixing means consisting of a body 15 having a different number of passages 16 than shown in the drawing and/or having passages 16 with a cross-sectional area differing from the area of the cross-sections shown in the drawing. The total cross-sectional area of the passages 16 in the body 15 is preferably between 10 and 50% of the area of the cross section of pipe 5. The large size cross-sectional area should be used when high fluid flow rates occur in the conduit system 1.

The point at which the fluid jets issuing from the downstream side of the passages 16 converge is situated below the downstream side of the body 15 at a distance which may be equal to approximately 2.5 times the diameter of the inner cylindrical wall of the annular support 14. It is observed that the mixing action is intensified by the way in which the outer circular row of passages 16 is arranged. The peripheries of said passages touch the periphery of the inner wall of the pipe 5. Those components of the fluid that preferably flow along the wall of this pipe are thereby forced to the center thereof, where they are mixed with the remaining part of the fluid.

The sampled fluid that is drained from the interior of the pipe 5 at a point where the components of the fluid to be sampled have been intensively mixed thereby forming a homogeneous mixture is passed through the conduit 22 at wellhead pressure to one or more storage containers (not shown), and stored therein at approximately the wellhead pressure. Sampling takes place during at least part of the period wherein fluid is flowing through the pipe 5, and after a sufficient volume of fluid has been sampled, the container or containers are transported to a laboratory for a detailed analysis of the fluid. If desired, a provisional analysis may be taken on site.

In some cases, it may be desired to obtain data on the separate components of the fluids. The sample stream of fluid is then passed from the conduit 22 into a gas/liquid separator 30 that operates at or approximately at wellhead pressure. This separator is of a small size compared to the gas/liquid separators that are designed for separating the components of the total fluid flow that may be produced by the well.

Best results will be obtained if the samples are stored in vacuum flasks, i.e., containers in which a vacuum (or nearly vacuum) can be created, and wherein the sample is supplied at the predetermined pressure (such as the wellhead pressure) at which the sample has been taken. If desired, the sampled components of the fluid may be stored separately in the flasks.

It will be appreciated that by storing the sample in containers under a pressure equal to or approximately equal to wellhead pressure, the sample remains representative for the fluid produced by the well, until the moment at which the properties of the fluid or the components thereof are determined.

After the sampling operation is finished, the conduit system 1 may be disconnected from the wellhead.

It will be appreciated that the application of the invention is not restricted to the use of the particular mixing means shown in FIGS. 2 and 3 of the drawing. Other mixing devices may be used as well, although best results may be expected when using the means above.

Wells producing fluids other than hydrocarbon fluids, such as nitrogen or carbon dioxide may also be tested by the means and the method according to the invention.

The pipes 5 and 6 should be arranged in the conduit system 1 so that parallel flow is allowed of fluids passing through the system. The central axes of the pipes 5 and 6, however, may have a non-parallel relationship. Optimum results may further be expected if the pipe 5 is vertically arranged and the fluid flow therethrough is directed downwards.

In an alternative embodiment, the body 15 may be arranged between two pipe parts of different cross-section. The part having the smallest cross-section then replaces the annular support 14 shown in FIG. 2. By interconnecting these pipe parts by flanges, the body 15 may easily be replaced by a mixing body having another number of passages 16 and/or comprising passages 16 of different cross-section.

It is observed that in the embodiment shown in FIG. 2, the sampling conduit 22 may be retracted over a small distance, such that the inlet 23 thereof is situated somewhat to the right side of the central axis of the body 15.

In still another alternative embodiment, sample point 23' may be arranged such that a sampling conduit after having been introduced into a pipe has the longitudinal axis thereof coinciding with the central axis of the pipe. The inlet opening of the sampling tube should then face upstream.

What is claimed is:

1. Method of taking a sample from a flow of fluid passing out of a well communicating with a permeable subsurface formation, which fluid comprises gaseous and liquid components, comprising the steps of:

allowing said fluid to flow from said well at a predetermined pressure;

dividing the fluid into a plurality of streams having axes which converge at a common downstream point;

mixing the streams of said fluid at said downstream point;

draining a sample stream of said mixed components at said predetermined pressure; and, storing said components at a pressure that is approximately equal to said predetermined pressure.

2. Method according to claim 1, including separating said components in a gas/liquid separator operating at approximately said predetermined pressure, and subsequently storing said separated components in separate containers.

3. Method according to claim 2, wherein storing said components includes supplying said components separately to vacuum flasks.

4. Method according to claim 1, wherein said fluid is a hydrocarbon fluid.

5. Apparatus for taking a sample from a flow of fluid passing out of a well communicating with a permeable underground formation, comprising:

a conduit system with an inlet and an outlet, said inlet being suitable for being brought into communication with the interior of said well, said conduit system comprising:

a first pipe and a second pipe arranged in a generally parallel configuration whereby parallel flow of fluid may take place through said first and second pipe;

valve means cooperating with each pipe, said valve means being arranged to close off said respective pipe at will;

fluid mixing means arranged in the interior of said second pipe and having a body with a central axis, said body having a plurality of passages extending therethrough between the upstream side of said body to the downstream side thereof, each passage having a central axis, the axes of all passages passing through a common point on the central axis of said body adjacent the downstream side of said body; and, a fluid sampling conduit communicating at its entry thereto with the interior of said second pipe in the proximity of said fluid mixing means.

6. Apparatus according to claim 5, wherein said body is arranged between pipe parts having cross-sections different in size, the part situated at the downstream side of said body having the smallest cross-section.

7. Apparatus according to claim 5 or 6, wherein the entries to said passages at the upstream side of said body are envely distributed over the area of the upstream side.

8. Apparatus according to claim 5 or 6, wherein part of said passages through said body have entry openings whose peripheries touch the periphery of the upstream side of said body.

9. Apparatus according to claim 5 or 6, wherein the total of the cross-sectional areas of said passages is between 10 and 50% of the cross-sectional area of the upstream side of said body.

10. Apparatus according to claim 6, wherein said pipe part downstream of said body has a circular cross-section and the distance between the downstream side of said body and said entry of said fluid sampling conduit is approximately 2.5 times the inner diameter of said pipe part situated at the downstream side of said body.

11. Method of taking a sample from a flow of fluid passing out of a well communicating with a permeable subsurface formation, which fluid comprises gaseous and liquid components, comprising the steps of:

passing said fluid through a first pipe from said well at a predetermined pressure;

passing said fluid through a second pipe in substantially parallel flow with said first pipe, said fluid being at said predetermined pressure;

mixing the components of said fluid being passed through said second pipe;

draining a sample stream of said mixed components at said predetermined pressure; and, storing said components at a pressure that is approximately equal to said predetermined pressure.

12. Method according to claim 11, wherein said fluid may be passed through said first pipe to the exclusion of said second pipe.

13. Method according to claim 11, wherein said fluid may be passed through said second pipe to the exclusion of said first pipe.

14. Apparatus for mixing gaseous and liquid components of a fluid comprising, a body with a central axis, said body having a plurality of passages extending therethrough between the upstream side of said body to the downstream side thereof, each passage having a central axis, the axes of all passages passing through a common point on the central axis of said body adjacent the downstream side of said body.

15. Apparatus according to claim 14, wherein said body is arranged between pipe parts having cross-sections different in size, the part situated at the downstream side of said body having the smallest cross-section.

16. Apparatus according to claim 14 or 15, wherein the entries to said passages at the upstream side of said body are evenly distributed over the area of the upstream side.

17. Apparatus according to claim 14 or 15, wherein part of said passages through said body have entry openings whose peripheries touch the periphery of the upstream side of said body.

18. Apparatus according to claim 14 or 15, wherein the total of the cross sectional areas of said passages is between 10 and 50% of the cross-sectional area of the upstream of said body.

* * * * *